US006293729B1

(12) United States Patent
Greppmair

(10) Patent No.: US 6,293,729 B1
(45) Date of Patent: Sep. 25, 2001

(54) COMPACTOR FOR COMPACTING SOIL

(75) Inventor: Martin Greppmair, München (DE)

(73) Assignee: Wacker-Werker GmbH & Co. KG, Munich (DE)

( * ) Notice: Subject to any disclaimer, the term of this patent is extended or adjusted under 35 U.S.C. 154(b) by 0 days.

(21) Appl. No.: 09/341,041

(22) PCT Filed: Feb. 11, 1998

(86) PCT No.: PCT/EP98/00768

§ 371 Date: Jun. 30, 1999

§ 102(e) Date: Jun. 30, 1999

(87) PCT Pub. No.: WO98/48119

PCT Pub. Date: Oct. 29, 1998

(30) Foreign Application Priority Data

Apr. 18, 1997 (DE) ..... 297 07 017 U

(51) Int. Cl.[7] ..... E01C 19/30
(52) U.S. Cl. ..... 404/133.1; 404/133.05
(58) Field of Search ..... 404/133.05, 133.1

(56) References Cited

U.S. PATENT DOCUMENTS 2,856,828 10/1958 Brown et al. ..... 94/48
3,160,216 * 12/1964 Ormes .
3,538,821 * 11/1970 Baeumers .
3,636,834 * 1/1972 Waschulewski et al. .
3,856,426 12/1974 Waschulewski ..... 404/31
4,015,909 * 4/1977 Yamamoto .
5,236,279 8/1993 Grinager ..... 404/133.05
5,645,370 * 7/1997 Zurbes et al. .

FOREIGN PATENT DOCUMENTS

3439534 * 5/1986 (DE) .
4-312603 * 4/1992 (JP) .

* cited by examiner

*Primary Examiner*—Thomas B. Will
*Assistant Examiner*—Gary S. Hartmann
(74) *Attorney, Agent, or Firm*—Boyle Fredrickson Newholm Stein & Gratz S.C.

(57) ABSTRACT

A compactor for compacting soil which can be controlled by hand using a bow-shaped control element or similar element. The compactor has a compacting or ramming working mass which is driven by a combustion engine back and forth, linearly, by a crank mechanism and a spring assembly. The compactor is also supported on the ground by a single-axle dolly.

27 Claims, 7 Drawing Sheets

COMPACTOR FOR COMPACTING SOIL

BACKGROUND OF THE INVENTION

1. Field of the Related Art

The invention relates to a tamping appliance for ground compaction, capable of being manually guided by means of a guide fork or the like and having a tamping or beating working mass driven linearly back and forth by an internal combustion engine via a crank mechanism and a spring assembly.

2. Discussion of the Related Art

Tamping appliances of this type, which are supported on the ground solely by means of the tamping butt, are guided in the desired direction by an operator as a result of the direct transmission of guiding forces by means of a guide fork, or, for example, a drawbar, during the oscillating movement of the tamping butt. When the drive is switched off, the appliance is difficult to transport, and it has to be carried or moved by means of a suitable device, such as, for example, a handcart.

On account of manual operation, the weight of such appliances is restricted, and therefore, for example, equipping them with relatively heavy diesel engines creates difficulties.

OBJECTS AND SUMMARY OF THE INVENTION

The object on which the innovation is based is to design a tamping appliance of the type initially mentioned, in such a way that handling becomes substantially easier, in particular the physical strength required for guiding it is reduced and it is possible, at any time, to change the location of the tamper in a simple way, when it is switched off, without any auxiliary devices.

This object is achieved in that the tamping appliance is additionally supported against the ground via an at least single-axle traveling gear By means of the traveling gear, the tamper can easily be moved without additional aids, even when the tamper drive is switched off. When the tamper is in operation, the guiding forces required are appreciably reduced on account of the rolling support of substantial weight components of the appliance. Moreover, there is the possibility of increasing the overall weight of the tamper beyond the limit hitherto considered acceptable and, for example, to provide the tamper with a heavy diesel engine.

A highly advantageous embodiment provides for the additional traveling gear to carry the internal combustion engine.

In another highly advantageous embodiment, the traveling gear is provided with its own drive, a common power source preferably being provided for generating the tamping movement and for driving the traveling gear. The traveling gear's own drive may advantageously be designed as a hydraulic drive or take place via a driving chain. The traveling gear drive can expediently be changed over between forward motion and reverse motion.

In order to ensure that the tamper, when switched off, is always in a stable position, the traveling gear may advantageously be designed as a three-point traveling gear by means of an additional supporting wheel on that side of the tamping butt which faces away from the driveable axle.

In order to keep as low as possible any wear of the traveling gear under the influence of the vibrations which are generated by the tamper and pass through the traveling gear, it is highly advantageous to stabilize the tamper upper mass connected to the traveling gear, that is to say to keep the movement of said upper mass as low as possible while the tamper is in operation.

Known manually guided tamping appliances are designed in such a way that the upper mass comprises approximately two thirds and the beating working mass or lower mass one third of the entire tamper mass, whilst the excursions covered in each case by the upper mass and the working mass are in inverse proportion to one another. Here, the upper mass moves in the order of magnitude of 25 to 30 mm.

This movement of the upper mass at a frequency of 10–11 Hz has many adverse effects, not only because these vibrations are transmitted to the body of the person guiding the working appliance via a guide fork, in particular to the hand and arm, but also because high loads are exerted on the mounted drive engine, irrespective of its design and, likewise, irrespective of the traveling gear which is provided according to the invention.

The output of the tamping system is largely dependent on the upper mass, since too large a working mass or too high a speed of the working mass moves the upper mass overdimensionally and aggravates the problems described above.

Although these harmful effects could, in part, be limited by a substantial increase in the upper mass, this would greatly increase the overall weight of the tamper, thus not only raising the power requirement of the drive engine, but also nullifying the benefit achieved by the traveling gear in making it easier to operate the tamper.

In order to stabilize the upper mass, without an appreciable increase in the weight of the appliance, and thereby lengthen its life, further improve its handling and protect the operator more effectively against the harmful effects of the vibrations, in a particularly advantageous embodiment of the appliance according to the invention the latter is provided, in the region of the upper mass, with a countermass capable of being driven by the engine jointly with the working mass, but in the opposite direction to the movement of the working mass.

The upper mass is pressed upward by a crank mechanism self-supported on its case at the moment when said crank mechanism, via its connecting rod, a guide piston and a spring assembly, presses the working mass, and consequently the tamping butt, downward. The result of the spring assembly is that, during the downward movement of the guide piston, first these springs are tensioned, at the same time absorbing energy, whereupon, with a delay induced thereby, they subsequently release the stored energy again for the downward movement of the tamping butt. This delay must be taken into account when the movement of the countermass is coordinated with the movement of the working mass. When the working mass is drawn upward again by the crankpin of the crank mechanism, the upper mass is moved downward.

For this purpose, in an advantageous embodiment, the drive of the countermass is derived from the crank mechanism, and the movement of the spring assembly end connected to the crank mechanism and the movement of the countermass are offset relative to one another with respect to the crank angle, by 180° minus a phase shift derived from the design parameters of the spring assembly.

When the spring assembly end connected to the crank mechanism exceeds the lower end point of its linear movement, the energy stored until then in the spring assembly is released as tamping or beating energy, so that only at this moment is the countermovement of the countermass required in order to damp the movement of the upper mass, or, in other words: the movement of the countermass to top dead center is to take place only when the spring assembly end connected to the crank mechanism has already reached bottom dead center. This is achieved by means of the above-described phase shift which, in practice, must be coordinated at least approximately with the design parameters.

According to an expedient embodiment, the countermass is guided on the upper mass in parallel with the direction of movement of the working mass. At the same time, in an advantageous embodiment, the countermass is driven by a compensating eccentric on the crank mechanism, specifically, for example, via a connecting rod. According to another expedient embodiment, the connection between the countermass and the compensating eccentric may be designed as a slider crank.

According to another expedient variant, the countermass consists of two part masses arranged in each case on one side of the crank mechanism or the other, at approximately the same height with respect to the axis of rotation of the crank mechanism, and each part mass is driven by an eccentric pin on an eccentric disk assigned to said part mass and rotatably coupled to the crank mechanism, the connection between the eccentric pin and the associated part mass being designed in each case as a slider crank.

In another advantageous variant, the countermass consists of unbalanced masses which are mounted on the upper mass rotatably about mutually parallel axes and are driven in rotation in opposite directions by the crank mechanism and of which the flywheel moment and mutual phase relationship are arranged in such a way that they generate a vibration directed in counteraction to the working mass, whilst, in another embodiment, the countermass consists of two centrifugal weights which are arranged next to one another, symmetrically to the direction of movement of the working mass, at approximately the same height in this direction, and which are directly coupled to one another rotatably in opposite directions and are driven by the crank mechanism.

In another expedient embodiment for the avoidance of lateral forces, the countermass consists of a first centrifugal weight seated directly on the shaft of the crank mechanism and of two second centrifugal weights of the same flywheel moment, which are arranged next to one another, symmetrically to the direction of movement of the working mass, at approximately the same height in this direction, and which are driven rotatably in the opposite direction to the first centrifugal weight by the crank mechanism and the flywheel moment of which is in each case approximately half as great as that of the flywheel moment of the first centrifugal weight.

In yet another variant, the countermass consists of a first centrifugal weight seated directly on the axis of rotation of the crank mechanism and of a second centrifugal weight which is arranged behind said first centrifugal weight and has approximately the same flywheel moment as the latter and is driven in the opposite direction to the first centrifugal weight about an axis of rotation somewhat offset relative to the axis of rotation of the crank mechanism in parallel with the direction of movement of the working mass.

BRIEF DESCRIPTION OF THE DRAWINGS

The innovation is explained in more detail with reference to the following description of its exemplary embodiments illustrated in the drawing in which.

DETAILED DESCRIPTION OF THE PREFERRED EMBODIMENTS

Figure 1:
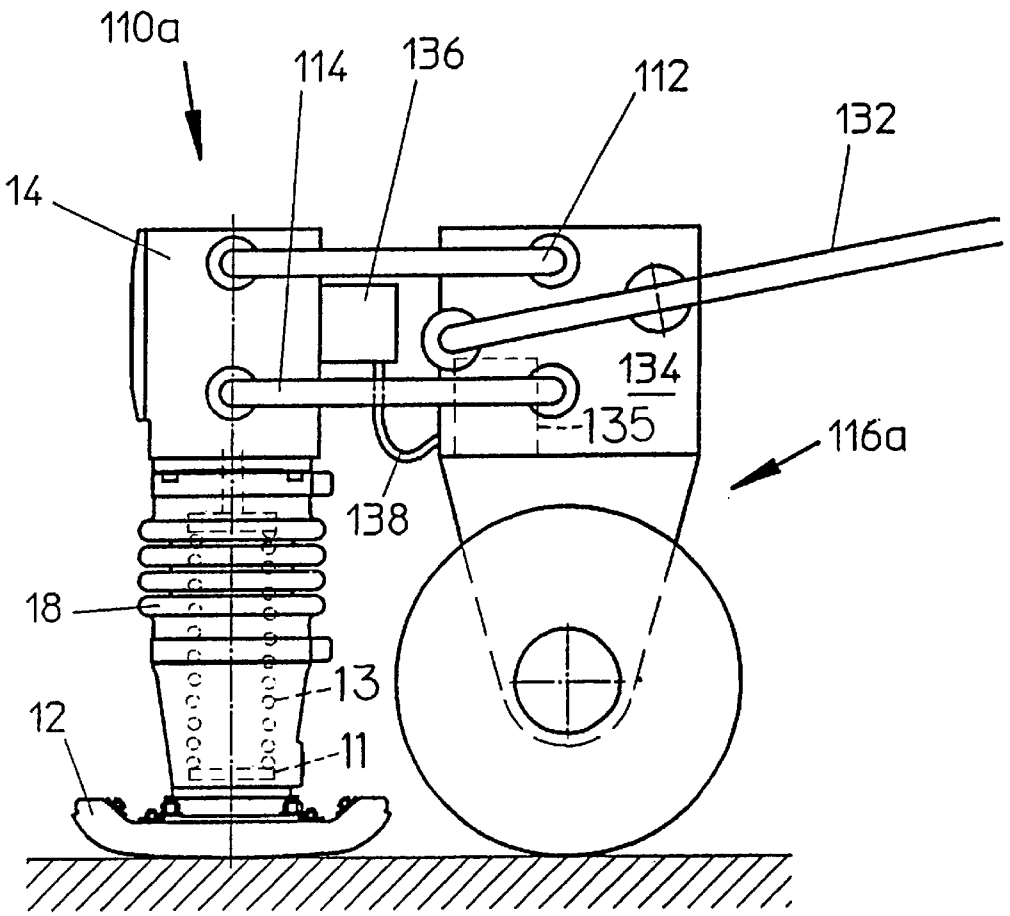
FIG. 1 shows a side view of a tamper designed according to the innovation, with a hydraulic drive of the single-axle traveling gear.
Figure 2:
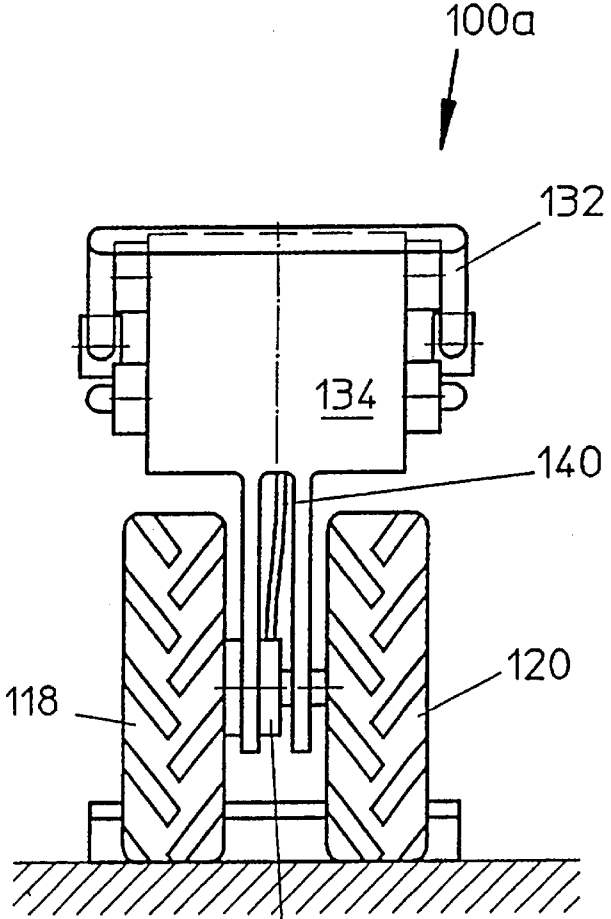
FIG. 2 shows a view from the right of the appliance shown in FIG. 1.
Figure 3:
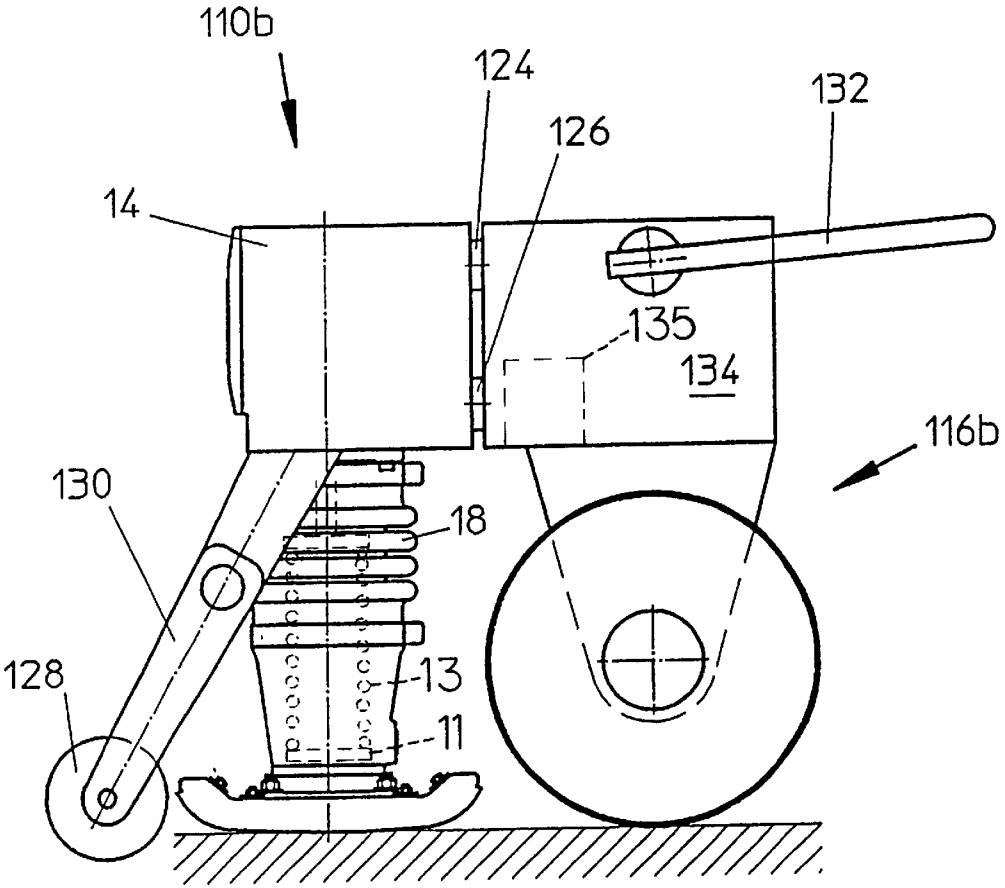
FIG. 3 shows a side view, similar to that of FIG. 1, of a tamper with a chain drive of the traveling gear and with an additional supporting wheel.
Figure 4:
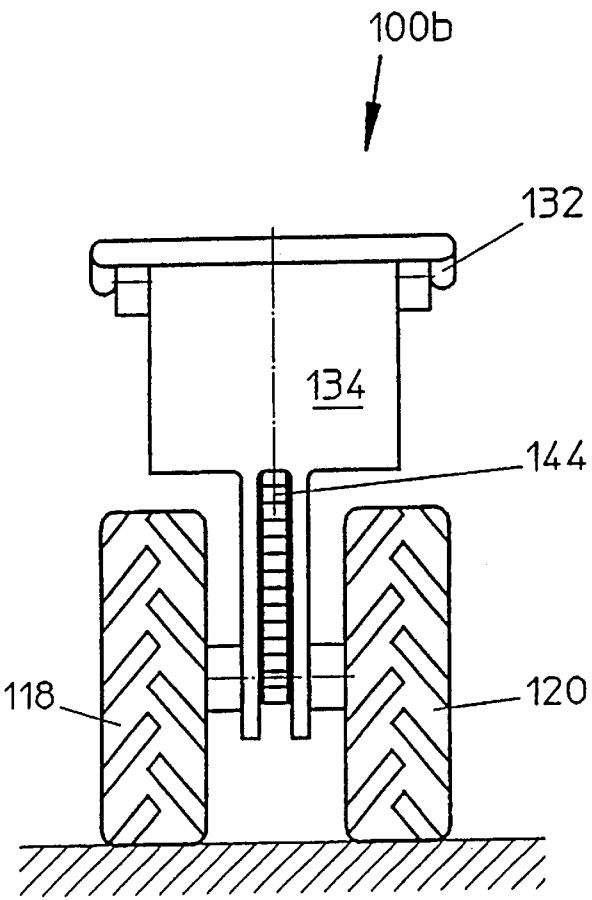
FIG. 4 shows a view from the right of the appliance shown in FIG. 3.

The tamping appliance designed according to the innovation is illustrated in a first embodiment, designated as a whole by 100*a*, in FIGS. 1 and 2 and in a second embodiment, designated as a whole by 100*b*, in FIGS. 3 and 4, the tamping implement, conventionally guided manually via a guide fork or a drawbar, being designated as 110*a* and 110*b* respectively. The tamping implement 110*a* is connected, via parallel links 112 and 114, to a single-axle traveling gear 116*a* having two wheels 118 and 120, the shaft of which does not exceed the width of the tamping butt 12 of the tamping implement 110*a*.

In the variant according to FIGS. 3 and 4, the tamping implement 110*b* is connected approximately rigidly to the traveling gear 116*b*, that is to say only slight relative movement becomes possible between the tamping implement 110*b* and the traveling gear 116*b* by means of elastic damping members 124 and 126 which are to counteract the transmission of vibrations to the traveling gear 116*b*. Another conspicuous difference is that the traveling gear 116*b* is supplemented by a third supporting wheel 128 so as to form a three-point traveling gear, in order to improve the stability, particularly when the tamping implement 110*b* is switched off. This third supporting wheel 128 is carried by an arm 130 mounted on the crankcase 14 of the tamping implement 110*b*.

Mounted on the traveling gear 116*a* or 116*b* is the guide fork 132 which is otherwise connected directly to the tamping implement 110*a* or 110*b*.

A crank mechanism arranged in the crankcase 14 of the tamping implement 110*a* or 110*b* serves for actuating the tamping butt 12, said crank mechanism being explained in more detail with reference to FIGS. 5 to 13. For driving the crank mechanism, the tamping appliance 100*a* or 100*b* is provided with an internal combustion engine 135 which is carried by the traveling gear 116*a* or 116*b* and is arranged in the region 134.

In the embodiment according to FIGS. 1 and 2, it is possible to have an oscillating movement with relatively large angular deflection between the tamping implement 110*a* and the traveling gear 116*a*. This appliance 100*a* is therefore equipped with a hydraulic drive which comprises a hydraulic pressure source connected to the engine, not shown, in the region 134. A hydraulic motor 136 for actuating the crank mechanism is mounted on the crankcase 14 and is connected to the pressure source via supply lines 138. Supply lines 140 lead, in the region of the traveling gear 116*a*, to a hydraulic drive 142 of the traveling gear wheels.

In the case of the relatively low movement between the tamping implement 110*b* and the traveling gear 116*b* a direct drive connection may be provided between the internal combustion engine arranged in the region 134 and the crank mechanism arranged in the crankcase 14, only slight compensation of the axial offset being necessary, which does not present any difficulties to the average person skilled in the art. A hydraulic drive may therefore be dispensed with and a chain mechanism 144 be provided for driving the wheels.

The tamping implement 110*a* or 110*b* consists, in dynamic terms, of a working mass 11 which is connected to the tamping butt 12 and which is connected, via a spring assembly 13 concealed by a concertina-like cladding portion 18, to a crank mechanism mounted in the so-called upper mass which is represented in FIGS. 1 to 4 by the crankcase 14. Oscillation is built up between the upper mass and working mass by means of the crank mechanism. In order to improve the handling and life of the appliance, the movement of the upper mass should be kept as low as possible. The measures described below with reference to FIGS. 5 to 13 serve this purpose.

Figure 5:
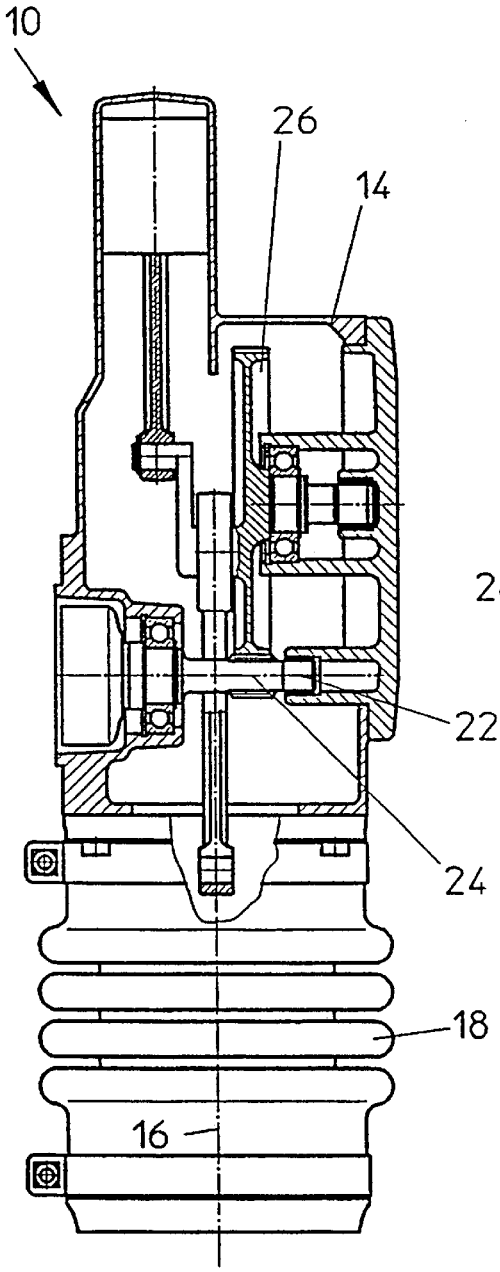
FIG. 5 shows a sectional view of a first embodiment of the crank mechanism for generating the tamping movement, with a countermass, as seen transversely to the crank axis and partially in section along a plane containing the crank axis.
Figure 6:
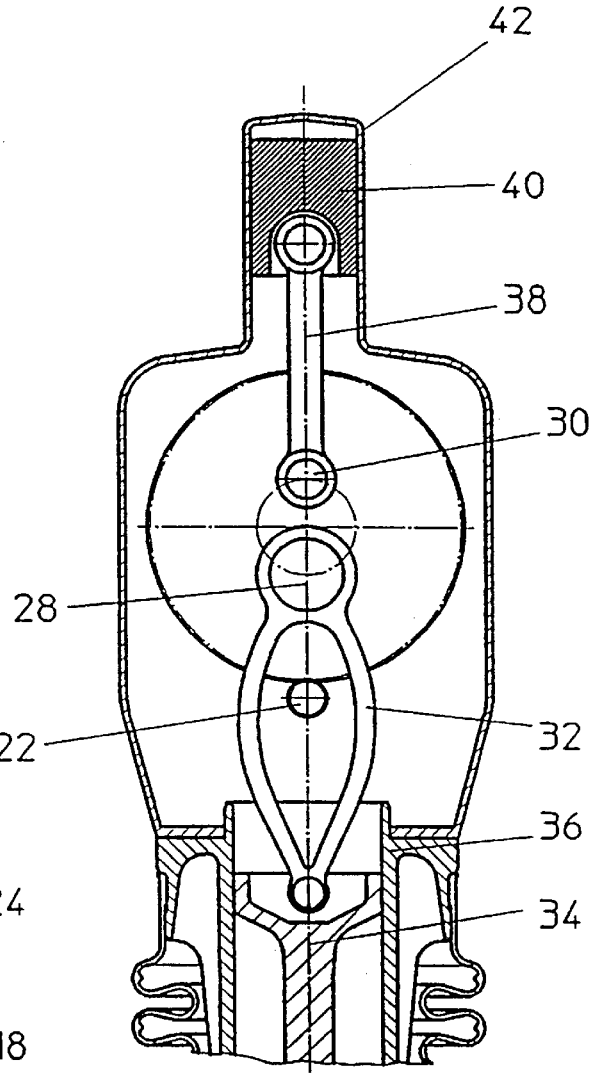
FIG. 6 shows a detailed section through the case of the crank mechanism of the embodiment shown in FIG. 5, in a plane at right angles to the crank axis.

As shown in FIG. 5, the crank mechanism is supplied with drive energy via a motor output shaft 22 provided with a toothed pinion 24 which is in engagement with a crank disk 26. The crank disk 26 carries two crankpins 28 and 30 offset at approximately 18° (FIG. 6). The crank pin 28 is connected, via a yokelike connecting rod 32 surrounding the output shaft 22, to a guide piston 34 which is arranged, moveably in the direction of the axis 16, in a piston guide 36 connected to the crankcase 14 and, being concealed in FIG. 5 by the concertina-like portion 18, is connected to the tamping butt 12 via the spring assembly. Connected to the crankpin 30 via a connecting rod 38 is a piston 40 which is likewise arranged, moveably in the direction of the axis 16, in a piston guide 42 and which, together with the connecting rod 38, forms a countermass to the working mass.

FIG. 6 shows an angular distance of 180° between the crankpins 28 and 30. The piston or the countermass 40 would thereby reach top dead center when the guide piston 34 connected to the spring assembly 13 (FIGS. 1 and 3) reaches its bottom dead center. For the reasons already described, however, the piston 40 is to reach top dead center with a time delay, depending on design features of the spring assembly, and because of this the angular distance must be selected smaller than 180° by the amount of a particular phase shift angle. In practice, this phase shift angle may be 50–70°.

Figure 7:
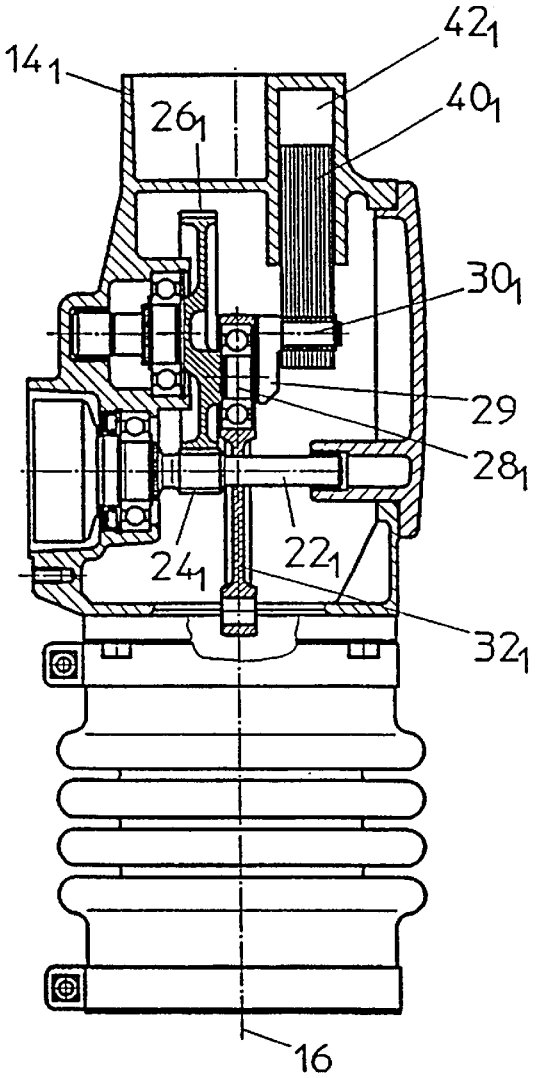
FIG. 7 shows a view, similar to that of FIG. 5, according to a second embodiment.
Figure 8:
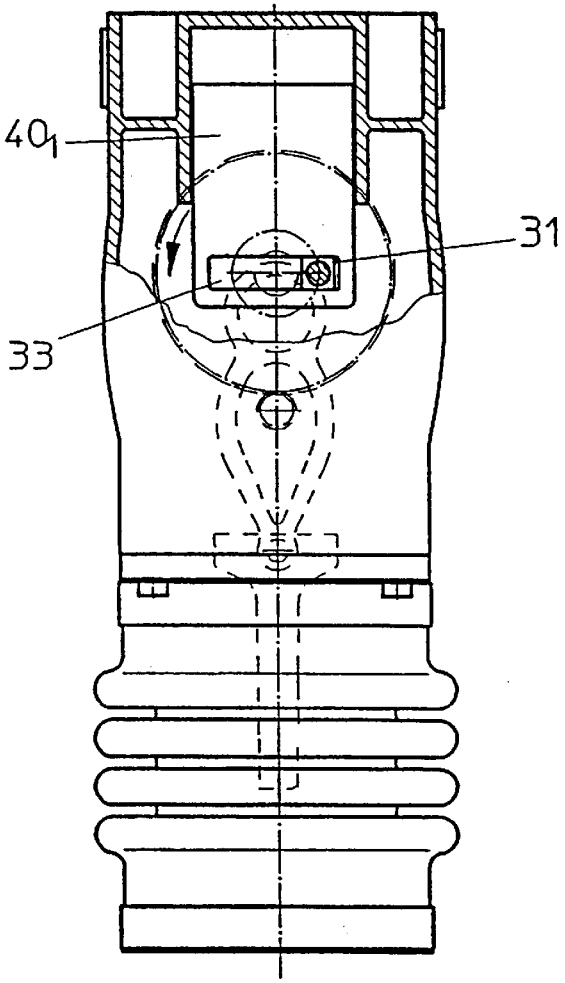
FIG. 8 shows a sectional view, similar to that of FIG. 6, of the second embodiment.

In the variant illustrated in FIGS. 7 and 8, the crank disk $\mathbf{26}_1$ which is engagement with the toothed pinion $\mathbf{24}_1$ on the output shaft $\mathbf{22}_1$ is provided with a crank 29 bent to form the crank pins $\mathbf{28}_1$ and $\mathbf{30}_1$ the crankpin 28which forms the free end of the crank 29 engaging into a sliding block 31 arranged displaceably in a guide slot 33 which is formed in a piston $\mathbf{40}_1$ serving as a countermass. The piston $\mathbf{40}_1$ is guided, so as to be moveable parallel to the axis of movement 16, in a guide $\mathbf{42}_1$ formed on the crankcase $\mathbf{14}_1$. Mounted on the crankpin $\mathbf{28}_1$ is the connecting rod $\mathbf{32}_1$ for connection to the guide piston (not shown) which serves for transmitting movement to the spring assembly. The functioning of this variant largely corresponds to the design according to FIGS. 5 and 6, but, by the countermass being driven by a slider-crank mechanism, makes it possible to have a design which is shortened in the direction of the axis of movement 16.

Figure 9:
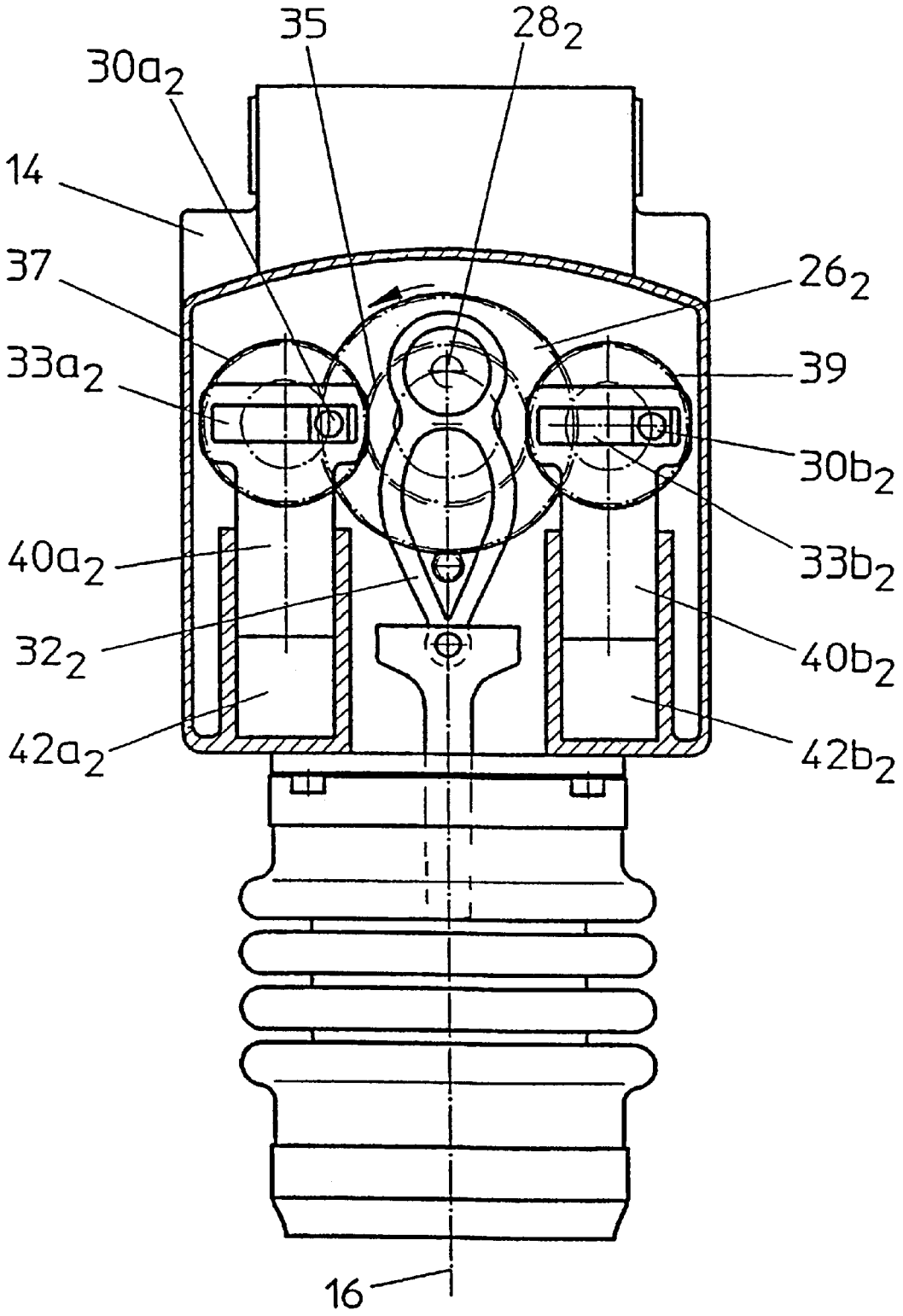
FIG. 9 shows a sectional view, similar to that of FIG. 8, in the case of a third embodiment.

FIG. 9 shows a variant which likewise provides a slider crank drive for the countermass, the arrangement making further shortening possible. The crank disk $\mathbf{26}_2$ provided with the crankpin $\mathbf{28}_2$ for the connecting rod $\mathbf{32}_2$ for the transmission of movement to the spring assembly is connected fixedly in terms of rotation to a gearwheel 35 which is arranged coaxially to said crank disk and with which two circumferentially toothed eccentric disks 37 and 39 are in engagement on both sides of the axis of movement 16 and at the same height with respect to the latter. The eccentric disks carry in each case an eccentric pin $\mathbf{30}a_2$ or $\mathbf{30}b_2$ which engage into guide slots $\mathbf{33}a_2$ and $\mathbf{33}b_2$, assigned to them, of two identically designed pistons $\mathbf{40}a_2$ and $\mathbf{40}b_2$ which together form the countermass and which are mounted, so as to be displaceable parallel to the axis of movement, in guides $\mathbf{42}a_2$ and $\mathbf{42}b_2$ assigned to them and formed on the crankcase $\mathbf{14}_2$.

The following variants replace the linearly moveable countermass by rotating unbalanced masses.

Figure 10:
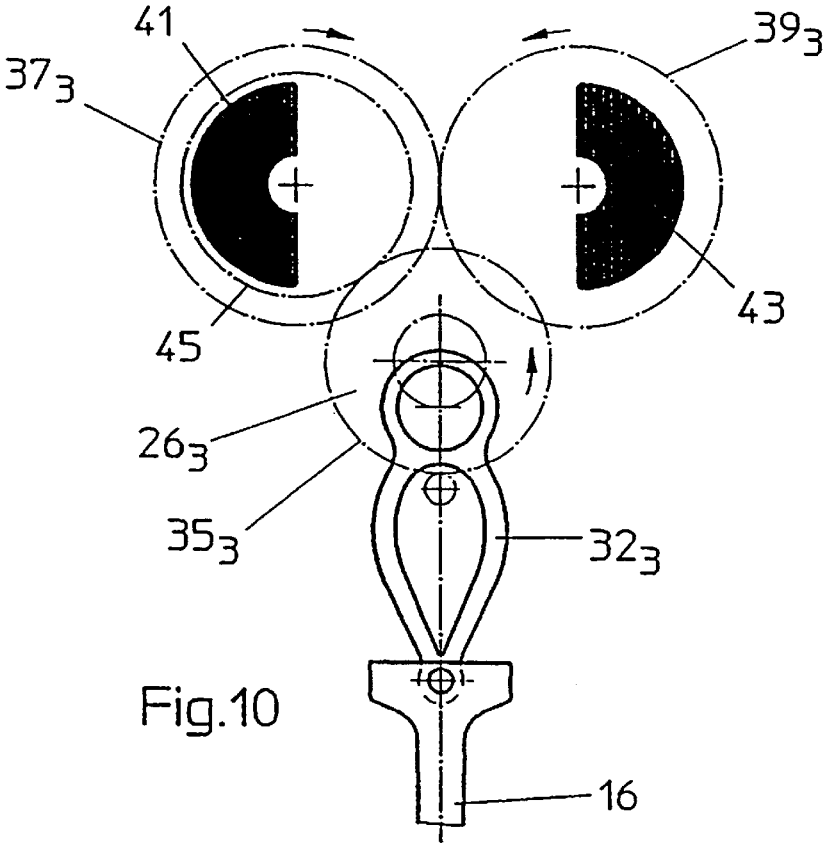
FIG. 10 shows a sectional view, similar to that of FIG. 8, in the case of a fourth embodiment.

In the variant according to FIG. 10, a gearwheel $\mathbf{35}_3$ is connected fixedly in terms of rotation and coaxially to the crank disk $\mathbf{26}_3$ for actuating the connecting rod $\mathbf{32}_3$. Two toothed disks $\mathbf{37}_3$ and $\mathbf{39}_3$ of equal size and of the same number of teeth, which are in engagement with one another and which are provided in each case with a centrifugal weight 41 and 43, are arranged on both sides of the axis of movement 16 and are the same distance from this and the same height with respect to the latter. The toothed disk $\mathbf{37}_3$ is connected fixedly in terms of rotation and coaxially to a gearwheel 45 which is in engagement with the gearwheel $\mathbf{35}_3$ of the same number of teeth, so that the two centrifugal weights 41 and 43 move in opposition, in a predetermined phase relationship, to the movement of the connecting rod $\mathbf{32}_3$. At the same time, the centrifugal weights 41 and 43 are arranged in such a way that their positions are in each case located opposite one another mirror-symmetrically to the axis of movement 16. As a result, both lateral forces, such as are caused by the oblique connecting rod 38 in the embodiments according to FIGS. 5 and 6, and frictional losses in the guides 33, $\mathbf{33}a_2$ and $\mathbf{33}b_2$ according to FIGS. 7 to 9, are avoided.

Figure 11:
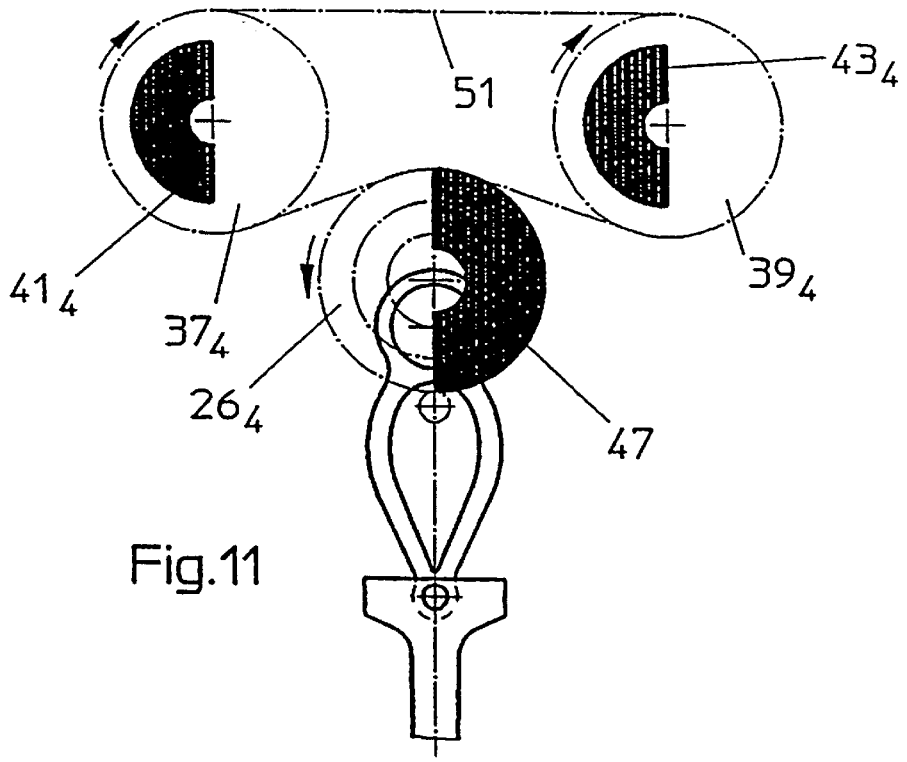
FIG. 11 shows a sectional view, similar to that of FIG. 8, in the case of a fifth embodiment.

The variant according to FIG. 11 shows an unbalanced mass acting in only one direction and located on the crank mechanism and two unbalanced masses which are in opposition thereto and which ensure mass compensation and therefore also prevent any lateral movement. The unbalanced mass on the crank mechanism is illustrated by the centrifugal weight 47 on the crank disk $\mathbf{26}_4$. Two disks $\mathbf{37}_4$ and $\mathbf{39}_4$, corresponding in diameter to the crank disk $\mathbf{26}_4$ and provided with centrifugal weights $\mathbf{41}_4$ and $\mathbf{43}_4$, are arranged symmetrically to the axis of movement. The three disks $\mathbf{26}_4$, $\mathbf{37}_4$ and $\mathbf{39}_4$ are connected for joint movement by means of a non-slip gear connection, for example a chain 51, in such a way that the two disks $\mathbf{37}_4$ and $\mathbf{39}_4$ move in the same direction of rotation, but in opposition to the crank disk $\mathbf{26}_4$.

Figure 12:
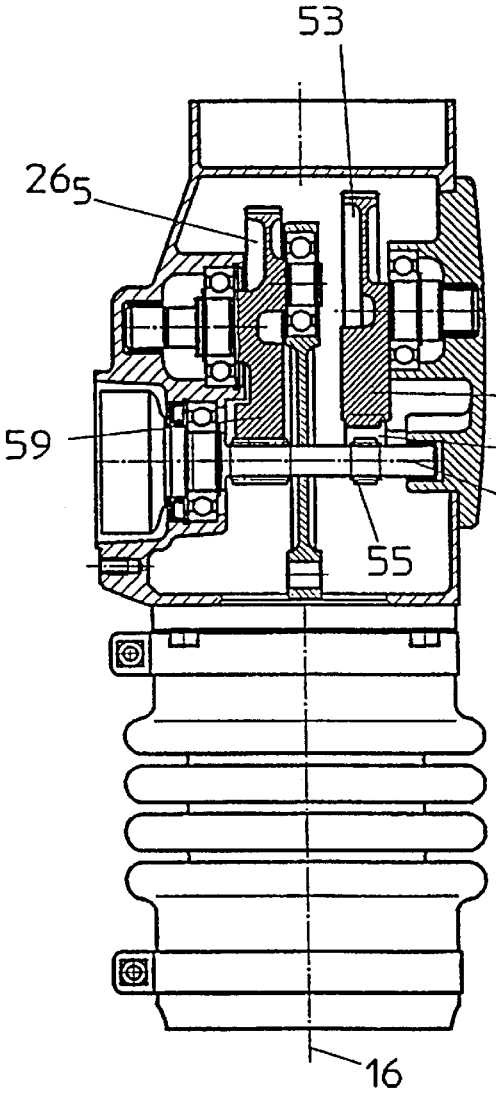
FIG. 12 shows a view, similar to that of FIG. 7, according to a sixth embodiment.
Figure 13:
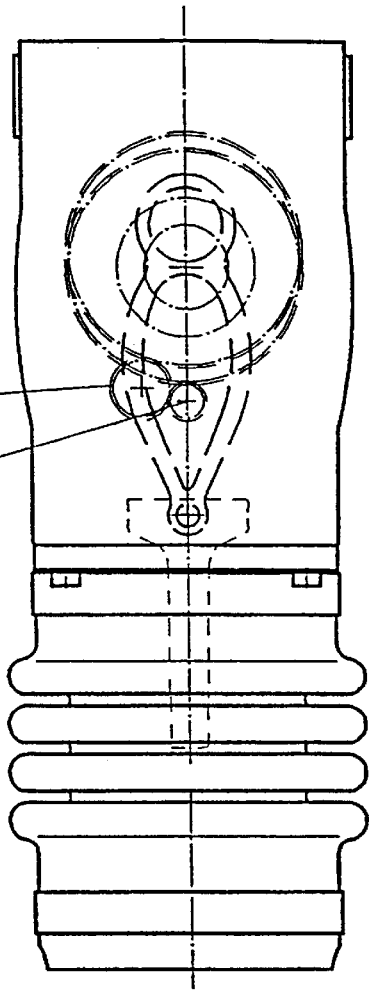
FIG. 13 shows a sectional view, similar to that of FIG. 8, of the second embodiment.

FIGS. 12 and 13 show a last variant which is a development of the variant according to FIG. 11 in as much as the two disks $\mathbf{37}_4$ and $\mathbf{39}_4$ rotating in the same direction are now replaced by a single disk 53 which is offset relative to the crank disk $\mathbf{26}_5$ in the direction of the output shaft $\mathbf{22}_5$ and which is driven via its own pinion 55 and an intermediate wheel 57 in opposition to the crank disk $\mathbf{26}_5$ by the output shaft $\mathbf{22}_5$ and is provided with a centrifugal weight 59.

What is claimed is:

1. A manually guided tamping appliance for ground compaction comprising:

a tamping implement having a working mass, a crank mechanism that is spaced from the working mass, and a spring assembly that is arranged between the crank mechanism and the working mass and that couples the working mass to the crank mechanism;

an internal combustion engine which drives the working mass linearly back and forth via the crank mechanism; and an at least single-axle traveling gear that additionally supports the tamping implement against the ground, wherein the entire tamping element is dynamically movable as a unit relative to the traveling gear.

2. The tamping appliance as claimed in claim 1, wherein the raveling gear carries the internal combustion engine.

3. The tamping appliance as claimed in claim 1, wherein the traveling gear is provided with its own drive.

4. The tamping appliance as claimed in claim 3, wherein the traveling gear drive is convertible between forward motion and reverse motion.

5. The tamping appliance as claimed in claim 3, wherein a common power source is provided for generating the tamping movement and for driving the traveling gear.

6. The tamping appliance as claimed in claim 5, wherein the crank mechanism is driven by a hydraulic power transmission.

7. The tamping appliance as claimed in claim 6, wherein an upper mass carrying the crank mechanism is movably connected to the traveling gear via a joint system.

8. The tamping appliance as claimed in claim 7, wherein the joint system includes parallel links.

9. The tamping appliance as claimed in claim 3, wherein the traveling gear is driven via a chain drive.

10. The tamping appliance as claimed in claim 1, wherein an upper mass carrying the crank mechanism is connected at least approximately rigidly to the traveling gear.

11. The tamping appliance as claimed in claim 10, wherein the upper mass is connected to the traveling gear so as to be moveable relative to the traveling gear to a limited extent via elastic connecting elements.

12. The tamping appliance as claimed in claim 10, wherein the traveling gear is supplemented by an additional supporting wheel that is located on a side of a tamping butt of the tamping implement which faces away from a driveable axle of the traveling gear and that, together with the traveling gear, forms a three-point traveling gear.

13. A manually guided tamping appliance for ground compaction comprising:

a tamping implement having a working mass, a crank mechanism, and a spring assembly arranged between the crank mechanism and the working mass;

an internal combustion engine which drives the working mass linearly back and forth via the crank mechanism; and an at least single-axle traveling gear that additionally supports the tamping implement against the ground, wherein the tamping implement is movable relative to the traveling gear; and a countermass capable of being driven by the engine in the opposite direction to the movement of the working mass over a large part of the range of movement of the working mass.

14. The tamping appliance as claimed in claim 13, wherein the countermass is driven by the crank mechanism.

15. The tamping appliance as claimed in claim 14, wherein the countermass includes two part masses arranged in each case on one side of the crank mechanism or the other, at approximately the same height with respect to the axis of rotation of the crank mechanism, and each part mass is driven by an eccentric pin on an eccentric disk assigned to said part mass and is rotatably coupled to the crank mechanism, and wherein each eccentric pin is connected to the associated part mass via a slider crank.

16. The tamping appliance as claimed in claim 14, wherein the countermass comprises unbalanced masses which are mounted on an upper mass of the tamping implement so as to rotate about mutually parallel axes, which are driven in rotation in opposite directions by the crank mechanism, and of which the flywheel moment and mutual phase relationship are arranged in such a way that they generate a vibration directed in counteraction to the working mass.

17. The tamping appliance as claimed in claim 16, wherein the countermass comprises two centrifugal weights which are arranged next to one another, symmetrically to the direction of movement of the working mass, at approximately the same height in the direction of movement of the working mass, which are directly coupled to one another rotatably in opposite directions, and which are driven by the crank mechanism.

18. The tamping appliance as claimed in claim 16, wherein the countermass comprises a first centrifugal weight seated directly on the shaft of the crank mechanism and two secondary centrifugal weights of the same flywheel moment, which are arranged next to one another, symmetrically to the direction of movement of the working mass, at approximately the same height in the direction movement of the working mass, and which are driven rotatably in the opposite direction to the first centrifugal weight by the crank mechanism, and wherein the flywheel moment of each of the secondary weights is approximately half as great as the flywheel moment of the first centrifugal weight.

19. The tamping appliance as claimed in claim 16, wherein the countermass comprises a first centrifugal weight seated directly on the axis of rotation of the crank mechanism and a second centrifugal weight which is arranged behind said first centrifugal weight, which has approximately the same flywheel moment as the first centrifugal weight, and which is driven in the opposite direction to the first centrifugal weight about an axis of rotation that is offset relative to the axis of rotation of the crank mechanism in parallel with the direction of movement of the working mass.

20. The tamping appliance as claimed in claim 13, wherein the movement of the spring assembly end and the movement of the countermass are offset relative to one another with respect to the crank angle by 180° minus a phase shift derived from design parameters of the spring assembly.

21. The tamping appliance as claimed in claim 13, wherein the countermass is guided on the upper mass in parallel with the direction of movement of the working mass.

22. The tamping appliance as claimed in claim 21, wherein the countermass is driven by a compensating eccentric on the crank mechanism.

23. The tamping appliance as claimed in claim 22, wherein the compensating eccentric drives the countermass via a connecting rod.

24. The tamping appliance as claimed in claim 22, wherein the countermass is connected to the compensating eccentric via a slider crank.

25. A manually guided tamping appliance for ground compaction comprising:

a tamping implement having a working mass and a crank mechanism that drives the working mass to reciprocate linearly;

an at least single-axle traveling gear that additionally supports the tamping implement against the ground;

an internal combustion engine that supplies drive power to the working mass;

a coupling that articulates the traveling gear to the tamping implement, the coupling being sufficiently flexible to permit limited dynamic movement of the tamping implement relative to the traveling gear; and a countermass that is driven by the engine in the opposite direction to the direction of movement of the working mass over a large part of the range of movement of the working mass.

26. A manually guided tamping appliance for ground compaction comprising:

a tamping implement having a working mass and a crank mechanism that drives the working mass to reciprocate linearly;

an at least single-axle traveling gear that additionally supports the tamping implement against the ground;

an internal combustion engine that supplies drive power to the working mass; and an elastic coupling that articulates the traveling gear to the tamping implement, the coupling being sufficiently flexible to permit limited dynamic movement of the entire tamping implement as a unit.

27. A tamping appliance as claimed in claim 26, wherein the engine is mounted on the traveling gear and is coupled to the tamping implement by the coupling.

* * * * *